US005657671A

United States Patent [19]

Morii

[11] Patent Number: 5,657,671

[45] Date of Patent: Aug. 19, 1997

[54] TORQUE TRANSMITTING APPARATUS

[75] Inventor: Yasushi Morii, Nagoya, Japan

[73] Assignee: Nippondenso Co., Ltd., Kariya, Japan

[21] Appl. No.: 515,570

[22] Filed: Aug. 16, 1995

[30] Foreign Application Priority Data

Sep. 16, 1994 [JP] Japan ..... 6-221916

[51] Int. Cl.[6] ..... F01L 1/344

[52] U.S. Cl. ..... 74/568 R; 74/409; 123/90.17; 464/161; 474/900

[58] Field of Search ..... 74/409, 568 R; 123/90.17; 464/160, 161; 474/900

[56] References Cited

U.S. PATENT DOCUMENTS

| | | | |
|---|---|---|---|
| 4,811,698 | 3/1989 | Akasaka et al. | 123/90.17 |
| 5,033,327 | 7/1991 | Lichti et al. | 74/56 BR |
| 5,163,872 | 11/1992 | Niemiec et al. | 123/90.17 X |
| 5,203,290 | 4/1993 | Tsuruta et al. | 74/568 R X |
| 5,426,992 | 6/1995 | Morii et al. | 74/409 |

FOREIGN PATENT DOCUMENTS

| | | | |
|---|---|---|---|
| 60-3111 | 1/1987 | Japan | 123/90.17 |
| 6-42316 | 2/1994 | Japan . | |
| 6-28203 | 4/1994 | Japan . | |

*Primary Examiner*—Allan D. Herrmann

*Attorney, Agent, or Firm*—Cushman, Darby & Cushman IP Group of Pillsbury Madison & Sutro LLP

[57] ABSTRACT

A control member of a torque transmitting apparatus is composed of pins, a retainer, a first and a second arc-shaped gears which form a single ring gear together, a piston, first springs and second springs. The first and second arc-shaped gears are biased respectively by the first and second springs in opposite directions so that the splines of the first and the second gears are deviated from each other while they are in mesh with corresponding splines of a sprocket sleeve and a cam sleeve. As a result, rattling noise due to backlash of the splines is suppressed even when torque change is transmitted to the sprocket sleeve.

11 Claims, 8 Drawing Sheets

TORQUE TRANSMITTING APPARATUS

CROSS REFERENCE TO RELATED APPLICATION

The present application is based on and claims priority from Japanese Patent Applications No. Hei 6-221916 filed on Sep. 16, 1994, the contents of which are incorporated herein by reference.

BACKGROUND OF THE INVENTION

1. Field of the Invention

The present invention relates to a torque transmitting apparatus which has a driving unit and a driven member and transmits driving torque of variable phase difference between the driving member and the driven member, and particularly, relates to a valve timing adjusting device for the air-intake and exhaust valves which changes the valve operation timing according to the engine condition.

2. Description of Related Art

Driving torque of an engine is transmitted to a valve timing adjusting device from the crank shaft of an engine through a timing belt, chain or gears to a timing pulley which is a driving member of the valve timing adjusting device. A ring gear is interposed between the timing pulley and a cam shaft (which is a driven member) of the valve timing adjusting device to transmit the driving torque to the cam shaft. The ring gear engages helical splines of the timing pulley and the cam shaft. When the ring gear is moved axially, the timing pulley rotates around the cam shaft to change the valve timings of the air intake valve and exhaust valve. Such device is disclosed in U.S. Pat. No. 4,811,698 (Japanese Patent Publication Hei 5-77842) and Japanese Unexamined Patent Publication Hei 6-42316 (U.S. Pat. No. 5,426,992 issued to the same assignee).

In the device disclosed in U.S. Pat. No. 4,811,698, a plurality of gears are connected by elastic members and installed between the timing pulley and the cam shaft.

In the device disclosed in Japanese Unexamined Patent Publication Hei 6-42316, a transmitting member is composed of a control member having a spline formed on an outer periphery within a partial circular range and arc-shaped gears disposed in the rest of the circumference, and is interposed between a driving member and a driven member. The control member and the gear are biased in the opposite directions by the elastic members.

The gears disclosed in the above publications are formed by dividing a single ring gear by a plane perpendicular to the gear axis or by a plane including the axis. They are connected by elastic members to bias one of the gears in one direction, thereby suppressing rattling noise due to backlash of the gears.

However, the above mentioned devices cannot suppress the rattling noise (due to the backlash of the gears) completely when the biased ring gear is further driven by an oil pressure member in the same direction as it is biased by the elastic member since the biasing force of the elastic member is overcome by the driving force, resulting in the backlash of the splines.

It is possible to suppress the backlash if the biasing force of the elastic member is increased. However, oil pressure has to be increased to move the ring gear in the opposite direction since frictional force of the splines increases.

SUMMARY OF THE INVENTION

The present invention is made in view of the foregoing problems, and therefore a primary object of the present invention is to provide a torque transmitting apparatus which suppresses the rattling noise of the splines which connect a driving member and a driven member without regard to the motion of the transmitting members.

Another object of the present invention is to provide a torque transmitting apparatus which includes a control member having at least two separate spline members disposed between a driving member and a driven member in mesh with splines of the driving member and driven member, a moving member connected to the separate spline members for changing relative position between the driving and driven member and means for biasing the separate spline members in opposite directions. The first and second splines includes a helical spline and at least one spline member includes a helical spline in mesh with first said helical spline. Accordingly, the connection between the driving member and the spline members, and the connection between the spline members and the driven member are made by splines without backlash and rattling noise is prevented without regard to operating condition of the apparatus.

Another object of the present invention is to provide a torque transmitting apparatus, wherein in addition to the above structure, the separate spline members include arc-shaped gears forming together a single gear. In other words, a single gear is divided into arc-shaped gears by an imaginal plane or imaginal planes including an axis of the single gear.

Another object of the present invention is to provide a torque transmitting apparatus, wherein in addition to the above structure, the separate spline members includes ring gears disposed axially to form a single ring gear. In other words, a single gear is divided into two ring gears by a plane perpendicular to an axis of said single ring gear.

A further object of the present invention is to provide a torque transmitting apparatus wherein, in addition to the above structure, the separate spline members includes a first arc-shaped gear and a second arc-shaped gear, and the means for biasing includes a first biasing member for biasing the first arc-shaped gear to separate from said moving member and a second biasing member for biasing said second arc-shaped gear against said moving member so that the means for biasing provides greater driving torque in a direction from the driving member toward the driven member than torque in a direction from the driven member toward the driving member. Since the torque change is generally applied to the driven member in a direction opposite the torque transmitting direction from the driving member to the driven member, the above structure gives smooth torque transmission.

A further object of the present invention is to provide a torque transmitting apparatus, wherein in addition to the above structure, the moving member includes a piston member disposed between the separate spline members and an oil pressure mechanism which includes a pressure chamber for driving said piston member axially.

BRIEF DESCRIPTION OF THE DRAWINGS

Other objects, features, and characteristics of the present invention as well as the functions of related parts of the present invention will become clear from a study of the following detailed description, the appended claims and the drawings. In the drawings:

DETAILED DESCRIPTION OF THE PREFERRED EMBODIMENT

The present invention is described with reference to figures next.

Figure 2:
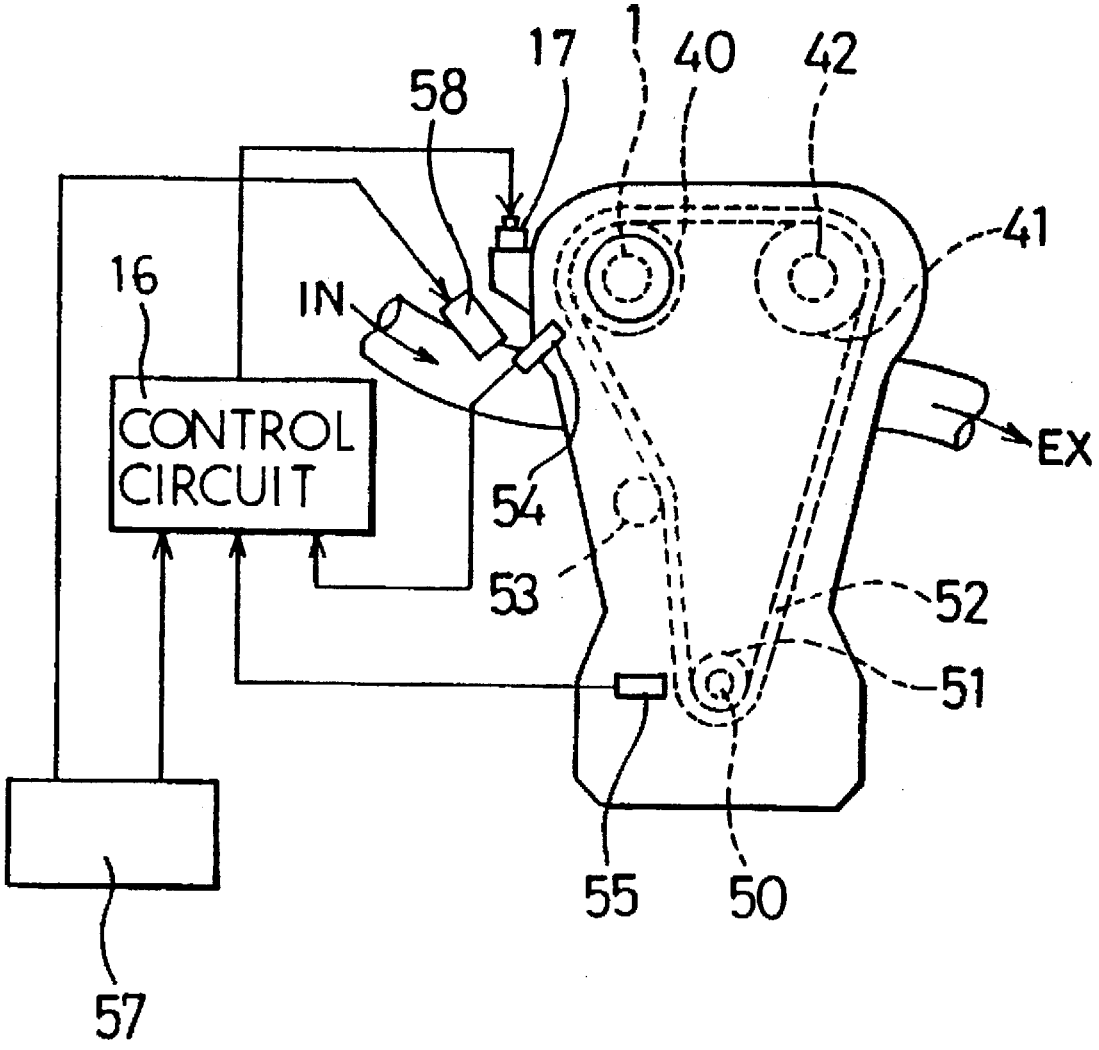
FIG. 2 is a schematic view illustrating an application of the valve timing adjusting device according to the first embodiment of the present invention to an internal combustion engine system of an automobile.

A valve timing adjusting device applied to an internal combustion engine system for an automobile according to a first embodiment is illustrated in FIG. 2.

The valve timing adjusting device is installed in an air-intake-side cam shaft 1 of a DOHC type internal combustion engine as a torque transmitting apparatus. An air-intake-side timing pulley 40 and a gas-exhaust-side timing pulley 41 are driven by a crank pulley 51, which is secured to a crank shaft 50 of the engine, through a timing belt 52 which is tensed by a tensioner 53, and consequently the air-intake-side cam shaft 1 and an exhaust-side cam shaft 42 rotate.

An oil pressure control valve 17 is feedback-controlled by a control circuit 16 to switch on and off a pressure passage to obtain a desired valve timing. A rotational speed sensor 54 generates a signal every given rotational angle in synchronism the rotational speed of the cam shaft 1, a rotational speed sensor 55 generates a signal every given rotational angle in synchronism with the rotation of the crank shaft 50, and both signals of the rotational speed sensors 54 and 55 are applied to input terminals of the control circuit 16. The control circuit 16 calculates the phase difference between the signals of the speed sensors 54 and 55 and controls the pressure control valve 17 to change the phase difference to a desired phase difference. The desired phase difference is determined according to a quantity of the intake air Q which is obtained from a fuel injection control device 57 for controlling a fuel injection valve 58 and a rotational speed signal of the engine, thereby to provide the most suitable valve timing for the engine operation.

The valve timing adjusting device according to the first embodiment of the present invention is illustrated in FIG. 1, FIG. 3 through FIG. 5. In the first embodiment, rotational torque is transmitted from a crank shaft (not shown) through a timing belt (not shown) to a timing pulley 5.

Figure 1:
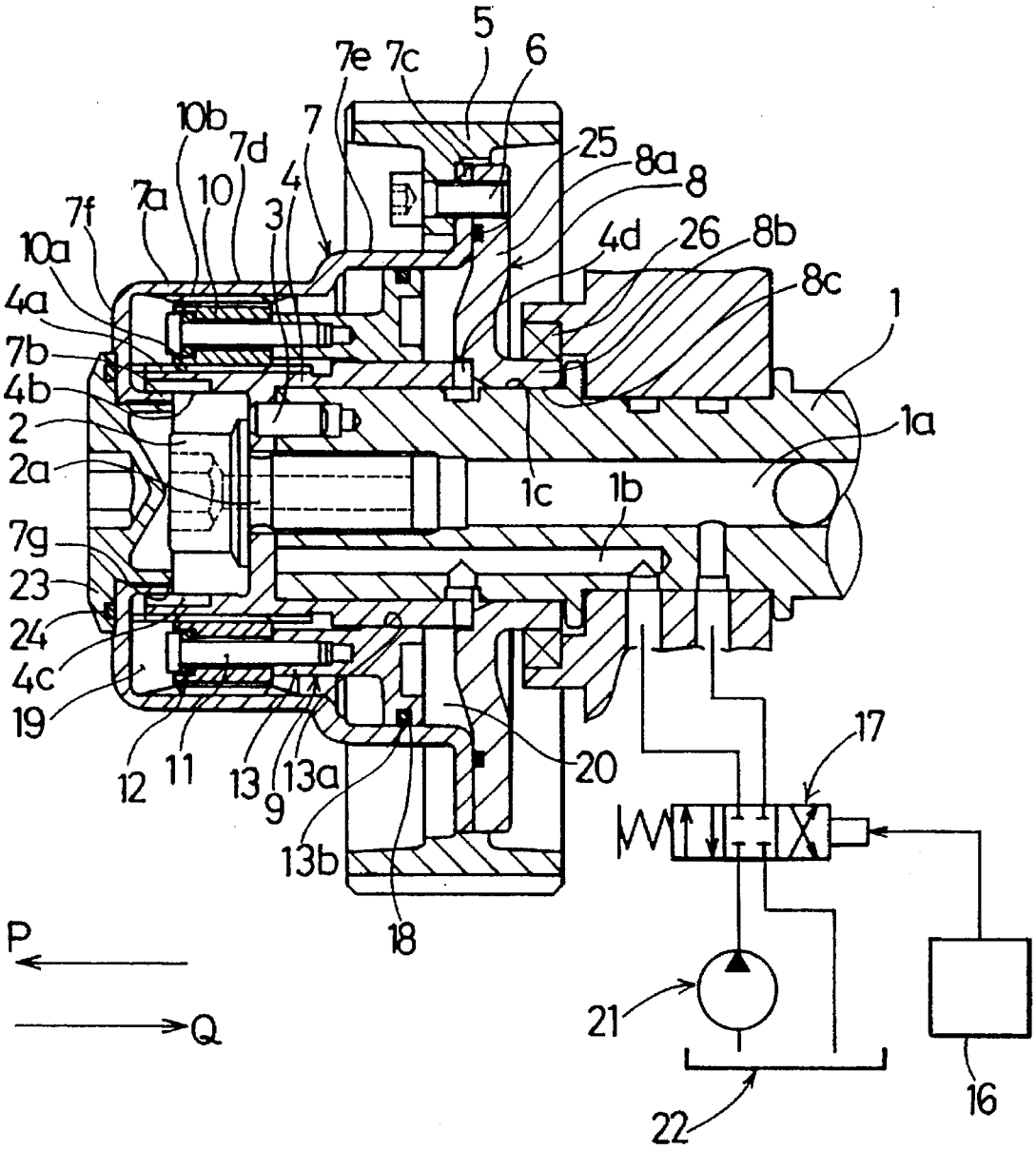
FIG. 1 is a cross sectional side view illustrating a valve timing adjusting device according to a first embodiment of the present invention.

A cylindrical cam shaft sleeve 4 is secured to an end of the cam shaft 1 by a bolt 2 and a pin 3 so as to rotate along with the cam shaft 1 as shown in FIG. 1. The cam shaft sleeve 4 has an outer helical spline 4*a* formed on an outer periphery thereof. A sprocket sleeve 7 includes an outer cylinder which has a smaller diameter portion 7*d* and a larger diameter portion 7*e*, a flange 7*c* (right portion of the sleeve), an inner cylindrical portion 7*b* and an intermediate annular portion 7*f* (between the smaller diameter portion 7*d* and the inner cylindrical portion 7*b*), which are formed integrally in a unit. An internal helical spline 7*a* is formed on an inner periphery of the smaller diameter portion 7*d*. The internal helical spline 7*a* is formed in a direction opposite the direction in which the outer helical spline 4*a* is formed. Either one of the outer and the inner helical splines 4*a* and 7*a* may be formed in parallel with the axial direction thereof.

A flange 8 has an annular portion 8*a* extending in a radial direction of the cam shaft 1 and a cylinder portion 8*b* extending to a rear portion of the cam shaft 1.

An annular portion 8*a* of the flange 8 and a flange portion 7*c* of the sprocket sleeve 7 are installed to the timing pulley 5 by a bolt 6. An outer surface 7*g* of the inside surface of the inner cylindrical portion 7*b* of the sprocket sleeve 7 is supported by an inner periphery 4*b* of the cam shaft sleeve 4, and an inner periphery 8*c* of the cylindrical portion 8*b* of the flange 8 is supported by an outer periphery 1*c* of the cam shaft 1 so that the timing pulley 5 rotates relative to the cam shaft 1 freely.

A control member 9 is disposed between the cam shaft 4 and the sprocket sleeve 7 so as to rotate the timing pulley 5 relative to the cam shaft 1. The control member includes pins 11, a retainer ring 12, piston member 13, an arc-shaped gear 10, an arc-shaped gear 14, a spring 27 and a spring 15.

Figure 3A:
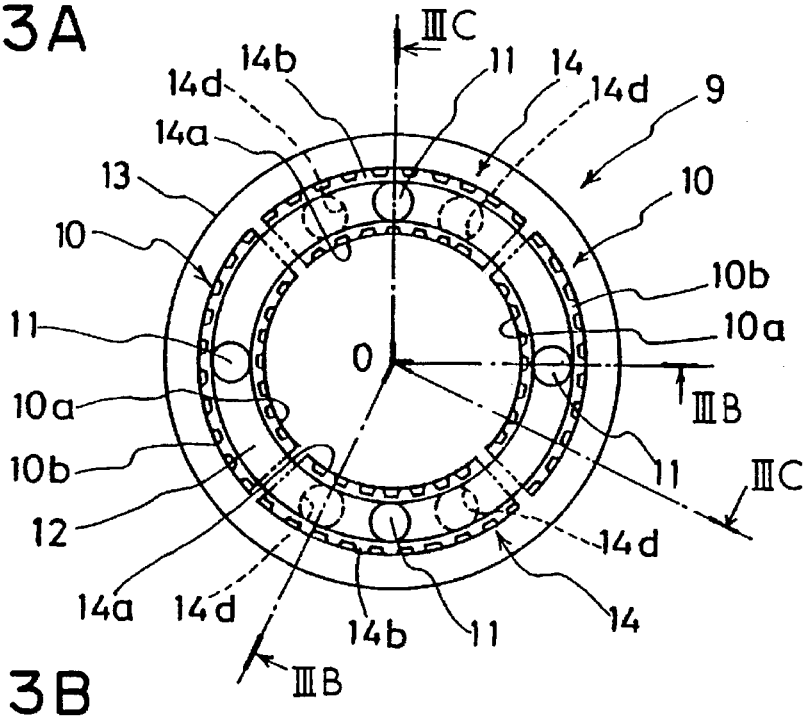
FIG. 3A is a plan view illustrating a control member of the first embodiment.
Figure 3B:
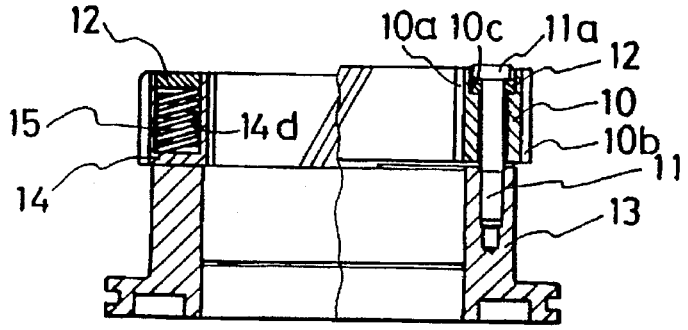
FIG. 3B is a cross-sectional view of the above member cut along a line IIIB—IIIB in FIG. 3A
Figure 3C:
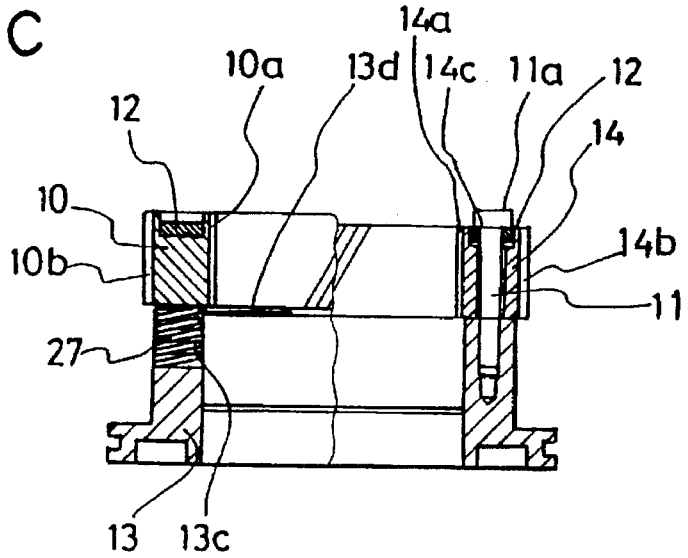
FIG. 3C is a cross-sectional view of the above member cut along a line IIIC—IIIC in FIG. 3A.

The arc-shaped gears 10 and 14 are formed from a ring-shaped gear, which is divided by perpendicular planes including the axis thereof. The arc-shaped gears 10 and 14 are installed to the piston member 13 alternately as shown in FIG. 3A as if they are combined into a single ring-shaped gear. Arc-shaped grooves 10*c* and 14*c* are formed on the respective end portions of the arc-shaped gears 10 and 14 as shown in FIGS. 3B and 3C, and a retainer rings 12 is fitted to the grooves 10*c* and 14*c*. The arc-shaped gears 10 and 14 are installed to the piston member 13 by pins 11 with a small clearance therebetween in the radial and rotational directions to absorb the accumulated errors when they are assembled. The pins 11 are inserted into respective through holes of the retainer ring 12 and press-fitted to the piston member 13. When the retainer ring 12 engages head portions 11*a* of the pins 12, the arc-shaped gears 10 and 14 are retained in the axial direction. Inner helical splines 10*a* and 14*a* are formed on the respective inner peripheries of the arc-shaped gears 10 and 14 and outer helical splines 10*b* and 14*b* are also formed on the respective outer peripheries thereof.

Spring holes 13*c* are formed at positions of the piston member 13 facing the arc-shaped gear 10 to accommodate springs 27 as shown in FIG. 3C. In other words, the springs 27 are disposed between the arc-shaped gear 10 and the piston member 13, and bias the arc-shaped gear 10 forward to separate from the piston member 13. A couple of spring holes 14*d* are formed on both sides of the through holes for the pins 11 are formed as shown in FIG. 3A, and springs 15 are accommodated therein under the retainer ring 12 as shown in FIG. 3B. That is, the springs 15 are disposed between the arc-shaped gear 14 and the retainer ring 12 and biases the arc-shaped gear 14 to separate from the retainer ring 12 (in the direction opposite the biasing direction of the spring 27). Axial movement of the arc-shaped gear 14 is restricted within the range of the operation of the spring 15.

Since the arc-shaped gears 10 and 14 are biased respectively in opposite directions with respect to the piston member 13, the outer helical splines 10*b* and 14*b* and also the inner helical splines 10*a* and 14*a* are shifted from each other in the axial direction thereof as shown in FIG. 3B and FIG. 3C before the control member 9 is installed between the sprocket sleeve 7 and the cam shaft sleeve 4.

Figure 4A:
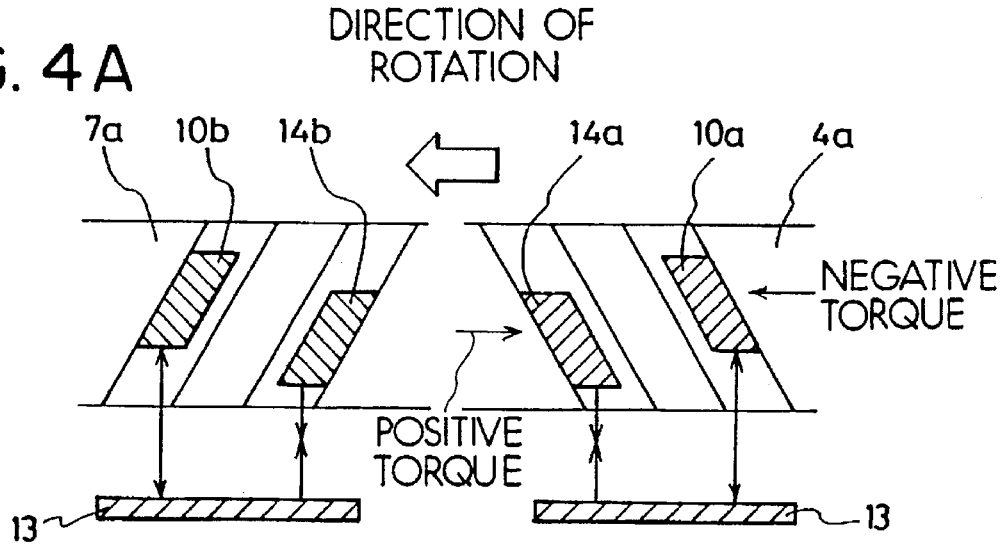
FIG. 4A, FIG. 4B and FIG. 4C are charts showing operations of the first embodiment.

After the control member 9 is installed between the sprocket sleeve 7 and the cam shaft sleeve 4, the arc-shaped gears 10 and 14 settle on the cam shaft with a smaller axial shift than the shift before they are installed, since they shift in axial and radial directions as much as they absorb backlash of the splines. The spring 27 and the spring 15 respectively and independently bias the arc-shaped gears 10 and 14 from opposite sides with regard to the piston member 13. Consequently, the arc-shaped gear 10 generates torque to rotate the cam shaft 1 to lag behind the timing pulley 5, and the arc-shaped gear 14 generates torque to rotate the camshaft 1 to lead ahead of the timing pulley 5. That is, when the control member 9 is disposed between thesprocket sleeve 7 and the cam shaft sleeve 4, the outer helical spline 10*b* of the arc-shaped gear 10 biases the inner helical spline 7*a* of the sprocket sleeve 7 in the phase-lagging direction, and the internal helical spline 10*a* biases the outer helical spline 4*a* of the shaft sleeve in the phase-lagging direction under a spring force of the spring 27 as shown in FIG. 4A. The spring 15 causes the outer helical spline 14*b* of the arc-shaped gear 14 to bias the inner helical spline 7*a* of the sprocket sleeve 7 in the phase-leading direction and also causes the inner helical spline 14*a* to bias the outer helical spline 4*a* of the cam shaft sleeve 4 in the phase-leading direction. As a result, the respective springs 27 and 15 give the arc-shaped gears 10 and 14 torque to respond positive and negative torque changes of the cam shaft 1 so that rattling noise due to the backlash of the splines can be suppressed.

Thus, the driving torque of the timing pulley 5 is transmitted to the cam shaft 1 through the sprocket sleeve 7, the control member 9 and the cam shaft sleeve 4.

An advancing pressure chamber 19 and a retarding pressure chamber 20 are formed between the cam shaft sleeve 4 and the sprocket sleeve 7, which are partitioned by a piston ring 18 fitted in a groove 13*b* and by a sliding portion 13*a* of the piston member 13. The advancing pressure chamber 19 and the retarding pressure chamber 20 are sealed by an O-ring 24 of a bolt 23, an O-ring 25 and the cylindrical portion 8*b*. An oil seal 26 further prevent the oil from leaking through the cylindrical portion 8*b* to the outside.

The control circuit 16 controls the oil pressure control valve 17 to supply the pressure oil through passages to the advancing oil pressure chamber 19 and the retarding oil pressure chamber 20. That is, the oil pressure control valve 17 switches over an oil passage connecting to the advancing pressure chamber 19 through a passage 4*c* formed on the cam shaft sleeve 4, a passage 2*a* formed in the bolt 2 and a passage 1*a* formed in the cam shaft 1 from an oil pump 21 to a drain 22 and vice versa, thereby controlling the oil pressure in the advancing oil pressure chamber 19. The oil pressure control valve 17 also switches over an oil passage connecting to the retarding pressure chamber 20 through an oil passage 4*d* formed in the cam shaft sleeve 4 and an oil passage 1*b* formed on the cam shaft 1 from the oil pump 21 to the drain 22 and vice versa, thereby controlling the oil pressure in the retarding oil pressure chamber 20. The control member 9 moves in the axial direction or stops according to the balance of the pressures of the advancing oil pressure chamber 19 and the retarding oil pressure chamber 20.

The operation of the valve timing adjusting device is described with reference to FIG. 3 and FIG. 4.

When the balance of the pressures in the advancing oil pressure chamber 19 and the retarding oil pressure chamber is controlled not to operate the control member 9, the sprocket sleeve 7 does not move relative to the cam shaft sleeve as shown in FIG. 4A. Since the arc-shaped gears 10 and 14 are biased by the springs 27 and 15 in the opposite directions along the axis, the outer helical spline 10*b* and 14*b* exert torque in the opposite directions respectively on the inner helical spline 7*a* of the sprocket sleeve 7, and the internal helical splines 10*a* and 14*a* exert torque in the opposite directions respectively on the outer helical spline 4*a* of the cam shaft sleeve 4. Thus even if the rotational speed of the cam shaft changes and the rotating torque changes its direction, rattling noise due to backlash of the splines are suppressed.

Figure 4B:
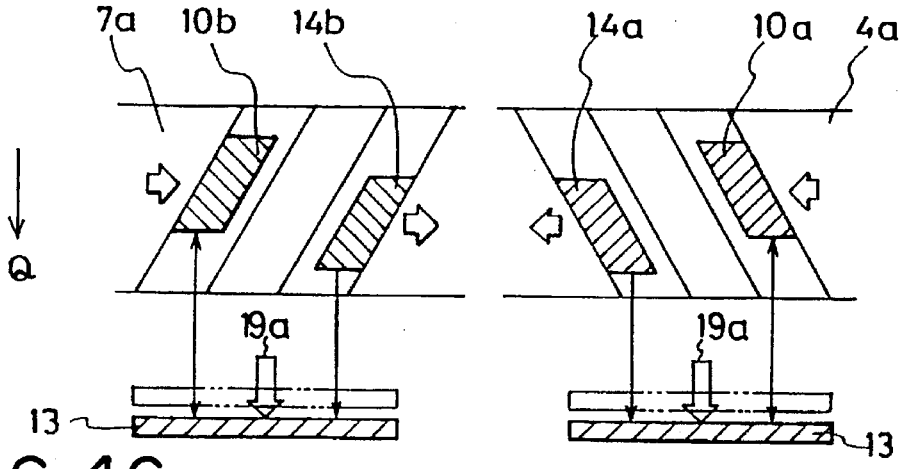

When the oil pressure in the advancing oil pressure chamber 19 is increased higher than the pressure in the retarding oil pressure chamber 20, the piston member moves to a direction indicated by an arrow Q (hereinafter referred to as direction Q) under an oil pressure 19*a* as shown in FIG. 4B. When the piston member moves slightly in the direction Q, the arc-shaped gear 14 abuts the retainer ring 12 and moves further in the direction Q together with the retainer 12. At this moment, the outer helical spline 10*b* and the inner helical spline 10*a* of the arc-shaped gear 10 exert the torque in the lagging direction on the inner helical spline 7*a* of the sprocket sleeve 7 and the outer helical spline 4*a* of the cam shaft sleeve 4 respectively. As a result, even when the control member 9 moves to the direction Q, changes in the torque of the cam shaft 1 may be absorbed and the rattling noise due to the backlash of the splines can be suppressed. It is noted that a driving force in a direction opposite the rotating direction is exerted on the inner helical spline 7*a* of the sprocket sleeve 7 and the driving force in the rotational direction is exerted on the outer helical spline 4*a* of the cam shaft 4. Accordingly, the camshaft rotates relative to the timing pulley 5 in a direction to lead ahead of the cam shaft 1.

Figure 4C:
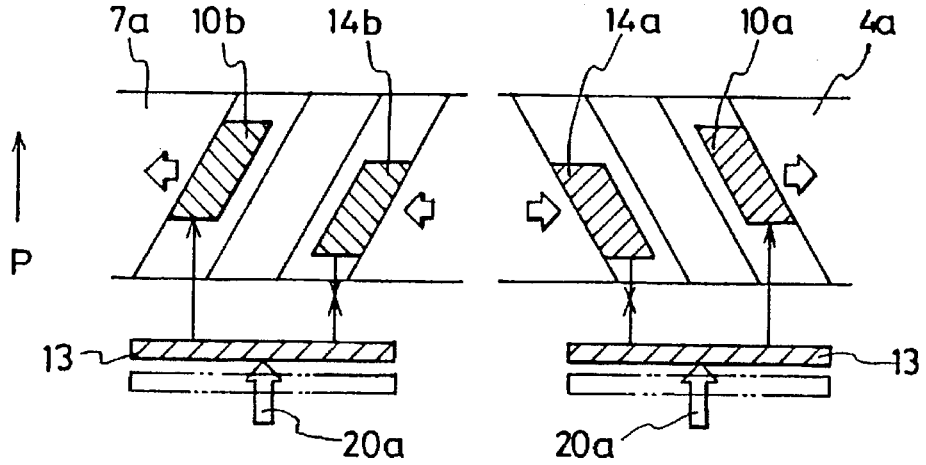

When the pressure in the retarding pressure chamber 19 becomes higher than the pressure in the advancing pressure chamber 20, the piston member 13 moves in a direction indicated by an arrow P (hereinafter referred to as direction P) under pressure 20*a* as shown in FIG. 4C. When the piston member 13 moves along the axis slightly, an end 13*d* of the piston member 13 abuts the arc-shaped gear 10 and further moves in the direction P together therewith. At this moment the outer helical spline 14*b* and the inner helical spline 14*a* of the arc-shaped gear 14 exert torque on the inner helical spline 7*a* of the sprocket sleeve 7 and the outer helical spline 4*a* of the cam shaft sleeve 4 in the phase leading direction. Therefore, even if the control member 9 is moving in the direction P, the rattling noise caused by the backlash of the splines is suppressed since the torque change of the cam shaft 1 is absorbed. It is noted that a driving force in the rotating direction is exerted on the inner helical spline 7*a* of the sprocket sleeve 7 and the driving force in the direction opposite to the rotational direction is exerted on the outer helical spline 4*a* of the cam shaft 4. Accordingly, the cam shaft 1 rotates relative to the timing pulley 5 in a direction to lag behind.

When the control member moves to the phase leading or phase lagging direction, the respective springs 15 and 27 generate rotation loads. Since the direction of a mean value of the torque change of the cam shaft 1 is opposite to the rotating direction of the timing pulley 5 and the cam shaft 1, the load to drive the control member 9 in the phase leading direction is greater than the load to drive it in the phase lagging direction. In order to equalize the operation of the control member 9 in both phase leading and phase lagging directions, the spring load of the spring 27, which provides the rotation load during the phase leading operation, is set smaller than the spring 15.

The first embodiment is compared with the operation of a device illustrated in FIG. 5 and FIG. 6, next.

Figure 5A:
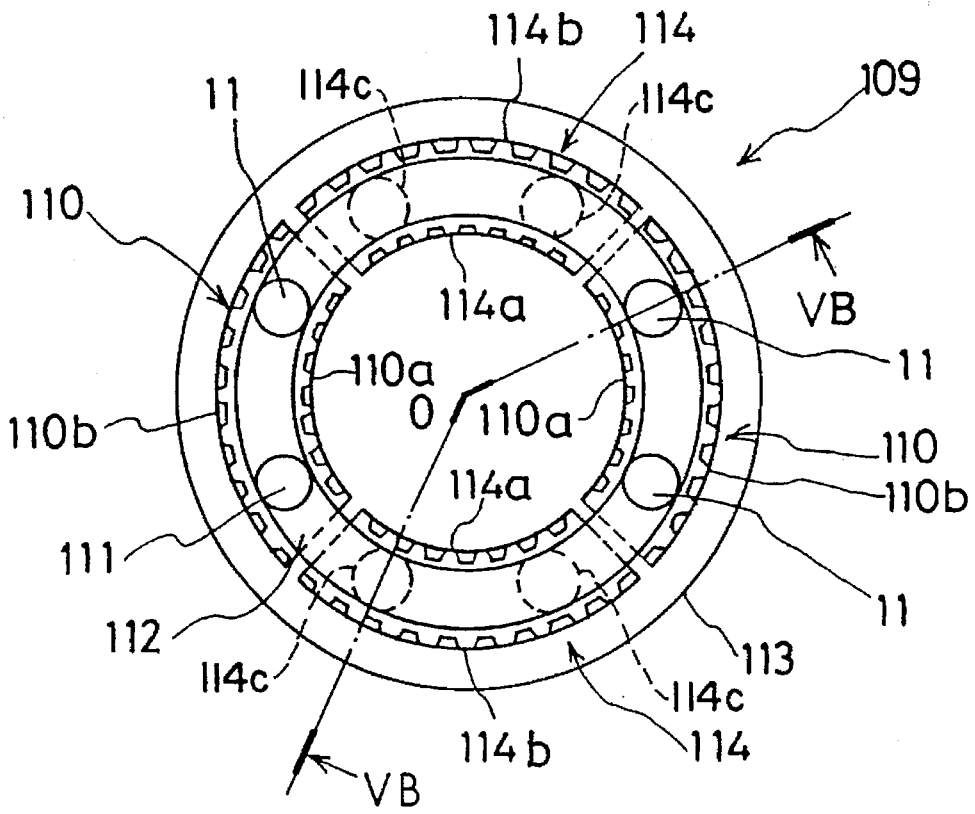
FIG. 5A is a plan view illustrating a control member of a device to be compared and FIG. 5B is a cross-sectional view of the above member cut along a line VB—VB in FIG. 5A.
Figure 5B:
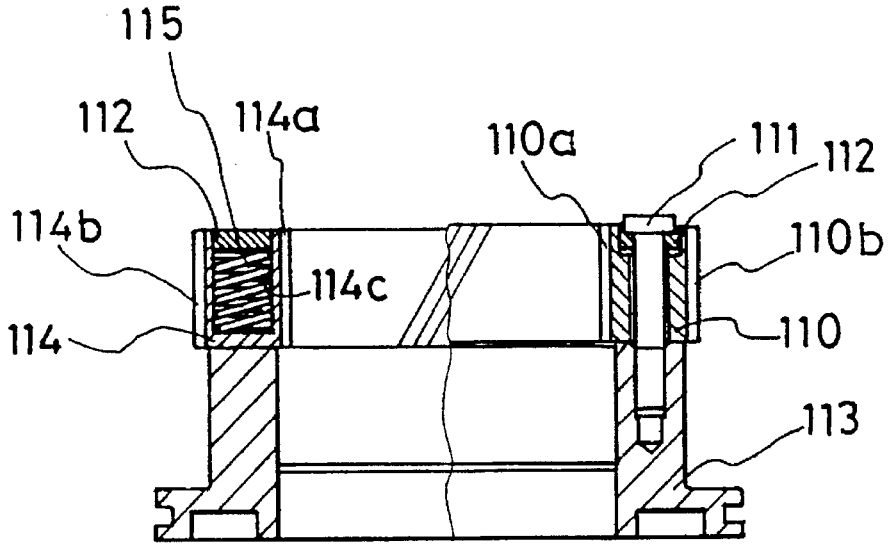

A control member 109 is composed of separate arc-shaped gears 110 and 114 and a piston member 113, and both arc-shaped gears 110 and 114 are installed to the piston member 113 as illustrated in FIG. 5A. The arc-shaped gears 110 and 114 have outer helical splines 110*b* and 114*b* respectively at their outer peripheries to engage with an internal helical spline 7*a* of the sprocket sleeve 7 and have internal helical splines 110*a* and 114*a* to engage the outer spline 4*a* of the cam shaft sleeve 4. The axial movement of the arc-shaped gears 110 and 114 are retained by pins 111 which are press-fitted to the piston member 113. Spring holes 114 are formed to accommodate springs 115 in the arc-shaped gear 114 as shown in FIG. 5B. The springs 115 bias the arc-shaped gear 114 toward the piston member 113. The arc-shaped gear 110 is movable axially within a small clearance formed between the gear 110 and a retainer 112.

The operation of the above sample is described next.

Figure 6A:
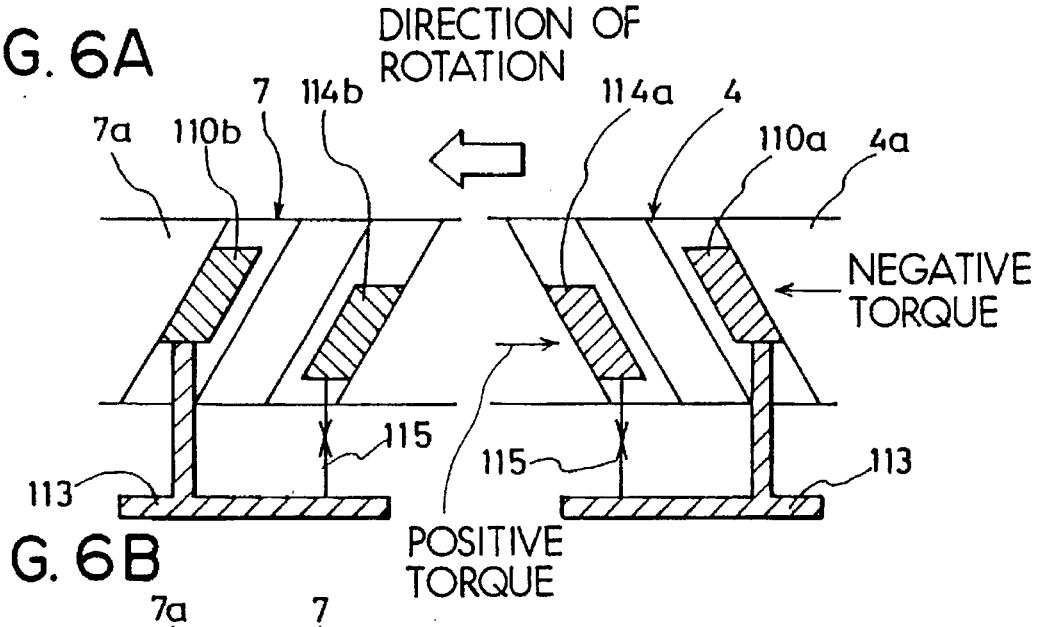
FIG. 6A, FIG. 6B and FIG. 6C are charts showing operations of the device illustrated in FIGS. 5A and 5B.

When the control member 109 does not move in the axial direction, the control member 109 does not drive the sprocket sleeve 7 and the cam shaft sleeve 4 (shown in FIG. 1). Since the arc-shaped gear 114 is biased against the piston member 113 by the spring 115 while the arc-shaped gear 110 is not biased, the outer helical splines 110*b* and 114*b* of both gears 110 and 114 are deviated axially from each other in engagement with the inner helical spline 7*a* of the sprocket sleeve 7 and the inner helical splines 110*a* and 114*a* are deviated axially from each other in engagement with the cam shaft sleeve 4, as shown in FIG. 6A. Thus, the rattling noise due to the backlash of the splines is suppressed even if the driving torque transmitted by the cam shaft changes to negative or positive.

Figure 6B:
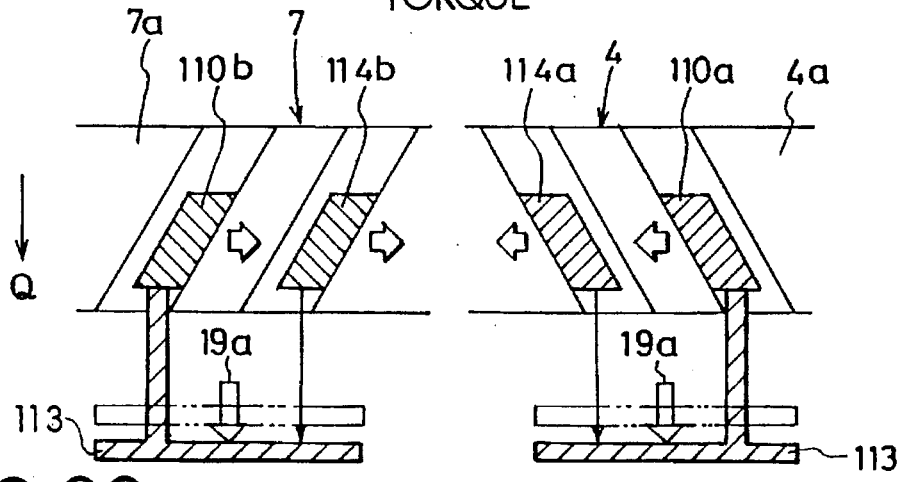
Figure 6C:
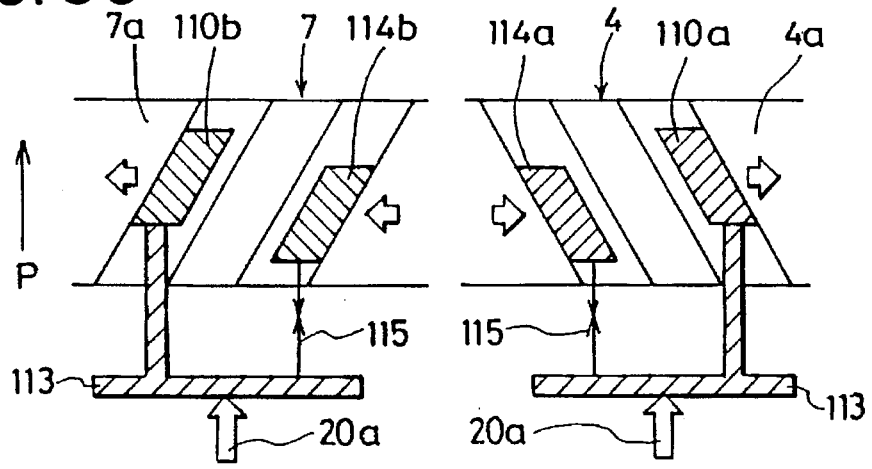

When the piston member 113 moves in the direction P, as shown in FIG. 6C, since the arc-shaped gear 114 is biased toward the piston member 113 (opposite the direction P), the splines of the arc-shaped gear 114 engage the helical splines of the sprocket sleeve 7 and the cam sleeve 4 without backlash. As a result, the rattling noise due to the backlash of the splines is suppressed even if the driving torque transmitted by the cam shaft changes to negative or positive.

However, when the piston member 113 moves in the direction Q (which is the same direction of the biasing force of the spring 115) as shown in FIG. 6B, the arc-shaped gear 114 moves opposite the direction Q against the biasing force of the spring 115. Consequently, the helical splines 110*a* and 110*b* of the arc-shaped gear 110 separate from the helical splines of the sprocket sleeve 7 due to the backlash of the splines and the cam shaft sleeve 4, resulting in the rattling noise due to the backlash if the torque change is generated.

The first embodiment, compared with the above sample, the springs 27 and 15 independently bias the arc-shaped gears 10 and 14 with respect to the piston member 9. Therefore, the backlash and rattling noise of the helical splines can be suppressed without regard to the motion of the control member 9.

Further, the pins 11 of the first embodiment are disposed on the retainer ring 12 at an equal pitch so that stresses applied thereto by the springs 15 and 27 can be equalized and the deformation thereof can be prevented.

Further, according to the first embodiment, an outer surface of the inner cylindrical portion 7*b* of the sprocket 7 is supported by the inner periphery 4*b* of the cam shaft sleeve 4, and the inner periphery 8*c* of the cylindrical portion 8*b* of the flange 8 is supported by the outer periphery 1*c* of the cam shaft 1. That is, the driving member composed of the timing pulley 5, the sprocket sleeve 7 and the flange 8 is supported by the driven member composed of the camshaft 1 and the cam shaft sleeve 4, and the distance between the positions where the driving member is supported by the driven member (between the inner periphery 4*b* and the outer periphery 1*c*) can be taken long enough to decrease the lean of the timing pulley 5, preventing considerable abrasion of the timing belt and increase of the engine vibration and enabling the torque transmission apparatus compact.

Figure 7A:
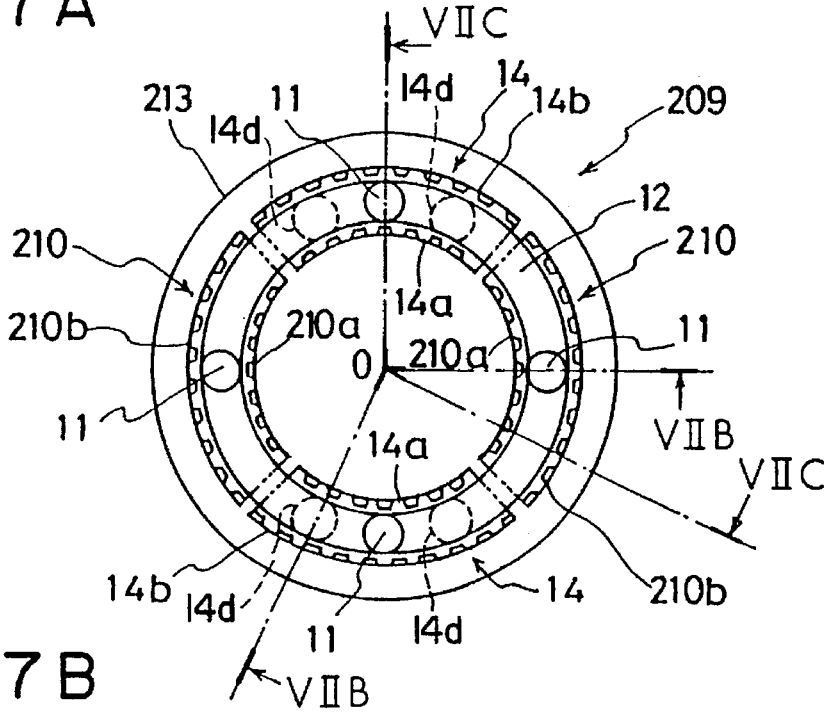
FIG. 7A is a plan view illustrating a control member of a second embodiment.
Figure 7B:
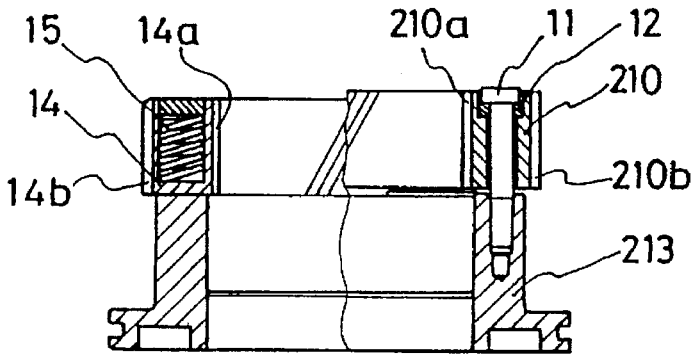
FIG. 7B is a cross-sectional view of the above member cut along a line VIIB—VIIB in FIG. 7A
Figure 7C:
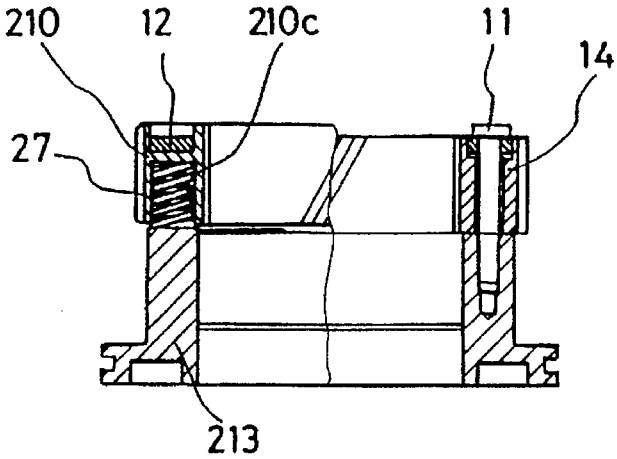
FIG. 7C is a cross-sectional view of the above member cut along a line VIIC—VIIC in FIG. 7A.

A second embodiment of the present invention is described with reference to FIGS. 7A, 7B and 7C, next.

A control member 209 is composed of an arc-shaped gear 209 and the arc-shaped gear 14 (which is the same as that of the first embodiment) and a piston member 213, and the gears 210 and 14 are connected to the piston member 213 in the same manner as in the first embodiment. The arc-shaped gear 210 has an outer helical spline 210*b* in mesh with the inner helical spline of the sprocket sleeve 7 and an inner helical spline 210*a* in mesh with the outer helical spline of the cam shaft sleeve 4 respectively as shown in FIG. 7A. The axial movement of the arc-shaped gear 210 is retained by the pins 11 which is press-fitted to the piston member 213 as shown in FIG. 7B. The arc-shaped gear 210 has spring holes 210*c*, which accommodate the springs 27 as shown in FIG. 7C. The springs 27 bias the arc-shaped gear 210 to separate from the piston member 213. The arc-shaped gear 14 is biased by the springs 15 against the piston member 213.

Since the springs 27 are accommodated by the spring holes 210*c* formed in the arc-shaped gear 210, the piston member 213 can be made simple. The arc-shaped gears 210 and 14 are biased axially in opposite directions with respect to the piston member 213, the rattling noise of the helical splines due to the backlash caused by the torque change of the cam shaft can be suppressed whether the control member 209 moves axially or not.

Figure 8A:
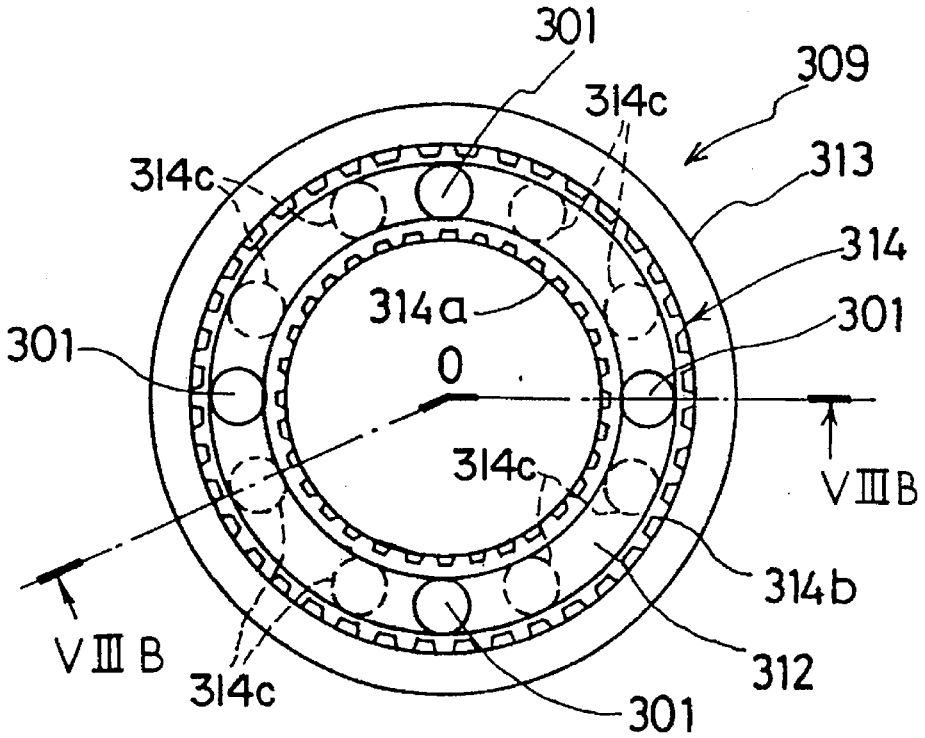
FIG. 8A is a plan view illustrating a control member according to a third embodiment and FIG. 8B is a cross-sectional view of the above member cut along a line VIIIB—VIIIB.
Figure 8B:
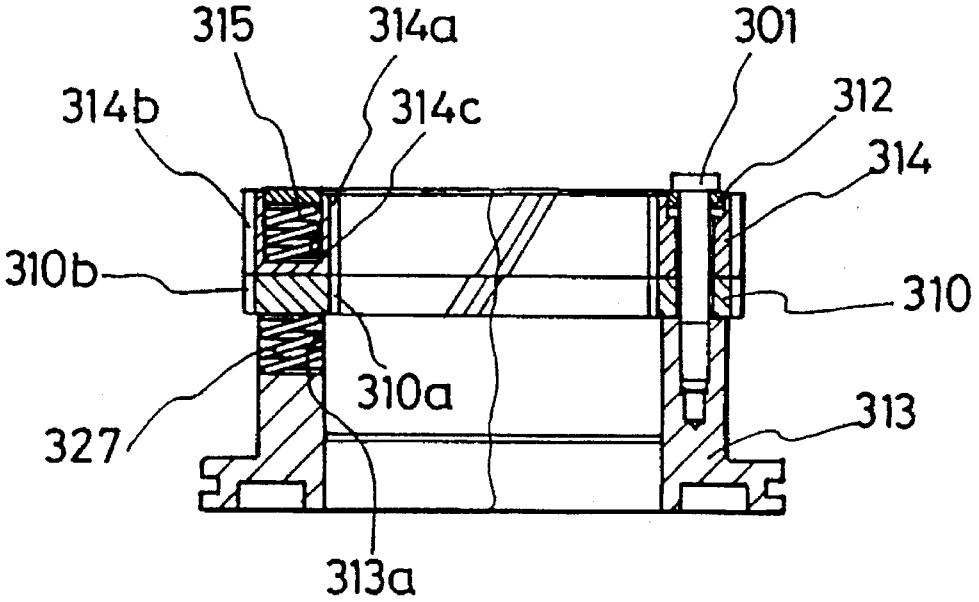

A third embodiment of the present invention is described with reference to FIGS. 8A and 8B.

A control member 309 is composed of a first ring gear 310, a second ring gear 314 and a piston member 313. The first and the second ring gears 310 and 314 are formed from a single ring gear, which is divided axially by a plane perpendicular to the axis thereof into two and disposed axially in order of the piston member 313, the first ring gear 310 and the second ring gear 314 as shown in FIG. 8B. A plurality of pin holes are formed in the first and second ring gears 310 and 314 and a retainer ring 312 to receive pins 301, which are inserted in the pin holes of the retainer ring 312, the second and first ring gears and press-fitted to the piston member 313. Movement of the second and first ring gears are restricted by the pin 301.

Outer helical splines 310*b* and 314*b* are formed around outer peripheries of the first ring gear 310 and the second ring gear 314 respectively, and inner helical splines 310*a* and 314*a* are formed on inner peripheries thereof respectively. Spring holes 314*c* and 313*a* are formed in the second ring gear 314 and the piston member 313 respectively. Springs 315 accommodated in the spring holes 314*c* bias the second ring gear 314 against the piston member 313, and springs 327 accommodated by the spring holes 313*a* bias the first ring gear 310 to separate from the piston member 313. The ring gears 310 and 314 have respective gear teeth whose tooth traces are aligned when the axial position of the gears are out of alignment. Therefore, when the first ring gear 310 and the second ring gear 314 are in alignment with each other before they are assembled, deviation of the tooth traces of both ring gears becomes maximum. When they are assembled, the first and second ring gears 310 and 314 separate from each other against biasing forces of the springs 315 and 327, so that the deviation decreases and, therefore, the control member can be installed between the sprocket sleeve and the cam shaft sleeve.

When the first and second ring gears 310 and 314 are installed between the sprocket sleeve 7 and the cam shaft sleeve 4 (as shown in FIG. 1), they are biased axially in the opposite directions with respect to the piston member 313, respectively. Since the helical splines of the first and second ring gears 310 and 314 are in mesh with the helical splines of the sprocket sleeve 7 and the cam shaft sleeve 4 with the tooth traces being deviated from each other, the torque change transmitted to the cam shaft can be absorbed whether the control member 309 is moved axially by the oil pressure or not as in the first and second embodiments.

The gears described in the previous embodiments are formed from a gear divided into two or more by a plane or planes including or perpendicular to the gear axis. However, they can be formed by other ways, for instance, from a gear divided by a plane or planes other than the above mentioned plane or planes.

Although both outer and inner helical splines are formed on the gears of the above embodiments, one of the outer and inner splines can be replaced by a straight spline.

One of the couple of splines in mesh with each other can be replaced by a key or projection in mesh with each other spline too.

The timing belt 52 is used to transmit the driving torque to the timing pulley in the embodiments, however a chain or a sprocket may be used for the driving torque transmission. In this case, the timing pulley is called the final stage gear. The valve timing adjusting device can be disposed in alignment with the crank shaft.

In the foregoing discussion of the present invention, the invention has been described with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than a restrictive, sense.

What is claimed is:

1. A torque transmitting apparatus including a driving member, a driven member and a control member disposed between said driving member and said driven member, wherein said control member comprises:

a set of a first spline member and a second spline member disposed between said driving member and said driven member for transmitting driving torque, said first and second spline members having common splines engaged with said driving member and said driven member including a helical spline;

a moving member connected to said first and second spline members for changing relative position between said driving member and said driven member; and means for biasing said first and second spline members in the opposite directions relative to said moving member.

2. A torque transmitting apparatus claimed in claim 1, wherein said set of first and second spline members comprises first arc-shaped gear and second arc-shaped gear respectively disposed in a circle to form a single gear.

3. A torque transmitting apparatus claimed in claim 1, wherein said set of first and second spline members comprises ring gears respectively disposed axially to form a single ring gear.

4. A torque transmitting apparatus claimed in claim 2, wherein said means for biasing comprises a first biasing member for biasing said first arc-shaped gear to separate from said moving member and a second biasing member for biasing said second arc-shaped gear to stay on said moving member so that said means for biasing provides greater driving torque in a direction from said driving member to said driven member than torque in opposite direction.

5. A torque transmitting apparatus claimed in claim 1, wherein said moving member comprises a piston member connected to said first and second spline members and an oil pressure mechanism including a pressure chamber for driving said piston member axially.

6. A torque transmitting apparatus claimed in claim 1, wherein said means for biasing provides greater driving torque in a direction from said driving member to said driven member than torque in opposite direction.

7. A torque transmitting apparatus for an internal combustion engine comprising:

a timing pulley;

a cam shift;

means, including a set of divided members which have respectively a first gear-coupling connected to said timing pulley and second gear-coupling connected to said cam shaft, for changing relative positions of said timing pulley and said cam shaft when driven axially;

driving means for driving said means for changing relative position axially along said cam shaft; and biasing members for biasing said set of divided members in opposite directions relative to said driving means.

8. A torque transmitting apparatus for an internal combustion engine claimed in claim 7, wherein said set of divided members comprises an arc-shaped gear which is a portion of a single gear divided by a plane including an axis of said single gear and an arc-shaped gear which is rest of said single gear.

9. A torque transmitting apparatus for an internal combustion engine claimed in claim 7, wherein said set of divided member comprises a ring gear which composes a portion of a single gear divided by a plane perpendicular to an axis of said single gear and a ring gear which is rest of said single gear.

10. A torque transmitting apparatus for an internal combustion engine claimed in claim 7, wherein said biasing member provides greater driving torque in a direction from said driving member to said driven member than torque in opposite direction.

11. A torque transmitting apparatus for an internal combustion engine comprising:

a driving member rotating along with a crank shaft of said engine;

a driven member rotating along with a cam shaft connected to valves of said engine;

means for transmitting driving torque, disposed between said driving member and said driven member, said means having a set of first and second members which have common splines engaged respectively with said driving member and said driven member, said common splines including a helical spline;

a moving member for driving said means in axial direction;

a first biasing means, disposed between said moving member and said means, for pressing said first member to separate from said moving member; and a second biasing means, disposed on a side of said second member opposite said moving member, for biasing said second member to stay on said moving member.

* * * * *